US005875992A

United States Patent [19]

Röder et al.

[11] Patent Number: 5,875,992

[45] Date of Patent: Mar. 2, 1999

[54] SUPPORTING JOURNAL FOR WINDING TUBE

[75] Inventors: Klaus Walter Röder; Hartwig Horst Trutschel, both of Würzburg, Germany

[73] Assignee: Koenig & Bauer-Albert Aktiengesellschaft, Wurzburg, Germany

[21] Appl. No.: 922,642

[22] Filed: Sep. 3, 1997

Related U.S. Application Data

[63] Continuation of Ser. No. 531,754, Sep. 21, 1995, abandoned.

[30] Foreign Application Priority Data

Sep. 21, 1994 [DE] Germany ..... 44 33 603.9

[51] Int. Cl.[6] ..... B65H 75/24

[52] U.S. Cl. ..... 242/573.4; 242/573.7

[58] Field of Search ..... 242/573, 573.7, 242/573.9, 571, 571.1, 571.2, 572, 573.2, 573.3, 573.5, 573.6, 575, 575.2, 575.4, 575.5, 573.4

[56] References Cited

U.S. PATENT DOCUMENTS

| | | | |
|---|---|---|---|
| 2,922,592 | 1/1960 | Kaltenbach . | |
| 3,355,121 | 11/1967 | Wright . | |
| 3,610,643 | 10/1971 | Thompson | 242/573 X |
| 3,738,588 | 6/1973 | Ayers | 242/575.3 X |
| 3,791,659 | 2/1974 | Hardin | 242/573.9 X |
| 3,945,585 | 3/1976 | Moslener | 242/573.9 X |
| 4,045,038 | 8/1977 | Obenshain | 24/575 X |
| 4,254,920 | 3/1981 | Peterson . | |
| 4,469,288 | 9/1984 | Pontes . | |
| 4,795,106 | 1/1989 | Weiss et al. | 242/573 X |
| 4,911,376 | 3/1990 | Thompson | 242/573.2 |
| 5,156,352 | 10/1992 | Ziessmer | 242/573.9 |
| 5,170,960 | 12/1992 | Pretto | 242/573 |
| 5,509,618 | 4/1996 | Kleiman et al. | 242/571.2 |

FOREIGN PATENT DOCUMENTS

| | | | |
|---|---|---|---|
| 1 264 204 | 3/1968 | Germany . | |
| 1 574 438 | 7/1970 | Germany . | |
| 1960534 | 5/1971 | Germany | 242/573 |
| 1 774 722 | 8/1971 | Germany . | |
| 7331865 | 9/1977 | Germany . | |
| 8901816.8 | 5/1989 | Germany . | |
| 1184405 | 3/1970 | United Kingdom . | |

*Primary Examiner*—Donald P. Walsh
*Assistant Examiner*—William A. Rivera
*Attorney, Agent, or Firm*—Jones, Tullar & Cooper, P.C.

[57] ABSTRACT

A retractable and extendable support journal for engaging and supporting paper web winding tubes in a printing press utilizes a plurality of spaced radially extendable and retractable clamping strips to securely connect the winding tube to the support journals. Each clamping strip has one or more material compressing or compacting ribs which compact the material of the winding tube to insure an interlocking connection between the tube and the support journal.

4 Claims, 3 Drawing Sheets

SUPPORTING JOURNAL FOR WINDING TUBE

This application is a continuation of application Ser. No. 08/531,754, filed Sep. 21, 1995, now abandoned.

FIELD OF THE INVENTION

The present invention is directed generally to a supporting journal for receiving a winding tube of a paper supply roll. More particularly, the present invention is directed to a retractable and extendable supporting journal for receiving and supporting a winding tube of a paper supply roll. Most specifically, the present invention is directed to a supporting journal having several radially extendable and retractable winding tube clamping strips positioned about its circumference. These clamping strips are movable in the radial direction of the supporting journal and extend axially along the supporting journal. Each clamping strip has a clamping face that can be brought into engagement with an inner peripheral surface of the winding tube. The clamping face of each clamping strip utilizes a winding tube material compression or compaction rib to compact the winding tube material, which is made of a compressible material and, in particular, is made of compressed kraft paper.

DESCRIPTION OF THE PRIOR ART

It is generally well known in the art to use paper web supply rolls in web-fed rotary printing presses. The web of paper is typically wound on a winding tube that may be made of a compressible material such as a compressed kraft paper. The winding tube is hollow and its ends are engaged by extendable and retractable support journals so that the paper web supply roll can be mounted for rotation in a roll stand. Since it is desirable to be able to monitor the rotational speed of the paper web roll and since it is also typically necessary to bring the paper web roll up to an appropriate web speed, as would be the case during a flying web splice, it is necessary that the support journals be able to securely yet releasably grip the interior peripheral surface of the winding tube. One way to accomplish this is to provide the retractable and extendable supporting journals with devices to change their effective circumferential size. One prior art arrangement of a spreadable supporting journals for clamping pipe or tube-shaped winding tubes and exchangeable roller bodies is shown in German Patent Publication DE 89 01 816.8 A. In this prior art device, the support journals are provided with clamping strips which are movable radially over the periphery of the journals. These clamping strips engage the interior circumference of the winding tube and thus clamp the winding tube to the support journal.

One limitation of this prior art device is its potential for causing damage to the interior surface of the winding tube. When the winding tube is a cardboard tube, it is possible that the tube can be damaged by the support journals. This is particularly apt to be the case when the paper web speed is in the range of 15 m/s and when it is necessary to rapidly stop the rotary printing press. If the paper web winding tube is damaged by the support journal, it cannot again be supported by other journals. The result is a large supply roll of a paper web whose supporting winding tube has been damaged so that it cannot be used again. It is then a difficult task to either transfer the paper web to an undamaged tube or to adapt the damaged tube in some manner so that it can be used.

It will be apparent that a need exists for a support journal which will securely grip a winding tube yet which will not damage the winding tube. The supporting journal for a winding tube in accordance with the present invention provides such a device and is a significant improvement over the prior art devices.

SUMMARY OF THE INVENTION

It is an object of the present invention to provide a supporting journal for a winding tube.

Another object of the present invention is to provide a retractable and extendable support journal.

A further object of the present invention is to provide a supporting journal having several radially extendable clamping strips.

Yet another object of the present invention is to provide a driven supporting journal which transfers driving and braking forces to a winding tube.

Still a further object of the present invention is to provide a supporting journal which will not damage its associated winding tube in spite of high moments of inertia which occur particularly during a rapid press stop.

As will be discussed in greater detail in the description of the preferred embodiment which is presented subsequently, the supporting journal for clamping winding tubes in accordance with the present invention is a retractable and extendable journal which has several axially extending, circumferentially spaced and radially shiftable clamping strips. These clamping strips can be moved radially out from the peripheral surface of the supporting journal and into clamping engagement with an inner peripheral face of the winding tube that carries the paper web. The winding tube is made of a compressible material, which is typically a kraft paper. The clamping strips compress or compact the winding tube material and in this way act to interlock the winding tube and the supporting journal. Each clamping strip has at least one material compressing or concentrating rib on its radially outermost clamping face or surface. This rib extends along the axial length of the clamping face of the clamping strip and acts as a key to insure a secure connection between the clamping strip and the winding tube.

The support journal in accordance with the present invention has several advantages over the prior art devices. The primary one of these is the ability of the support journal to transfer forces to the winding tube in such a manner that the tube is not destroyed in the process. The paper material of the paper winding tube, which is preferably a wound kraft paper, is compressed or concentrated by the material compacting or compressing ribs on the clamping faces of the clamping strips of each supporting journal. These compacting or compressing ribs act in the manner of keys and accomplish a large penetration depth with low end face pressure. The forces to be transferred from the supporting journals by the clamping strips to the winding tube, are transferred in a manner so that the cardboard tube is not destroyed in the process. The special and unique structure and configuration of the clamping strips effectively form-locks the strips to the winding tube. The result is that the winding tube will not be cut or torn by the clamping strips and will not burst or break during rapid printing press stoppages or start-ups.

The supporting journal for winding tubes of paper supply rolls in accordance with the present invention overcomes the limitations of the prior art and is a substantial advance in the art.

BRIEF DESCRIPTION OF THE DRAWINGS

While the novel features of the supporting journal for winding tubes in accordance with the present invention are set forth with particularity in the appended claims, a full and complete understanding of the subject invention may be had by referring to the detailed description of the preferred embodiment which is presented subsequently, and as illustrated in the accompanying drawings, in which:

DETAILED DESCRIPTION OF THE PREFERRED EMBODIMENT

Figure 2:
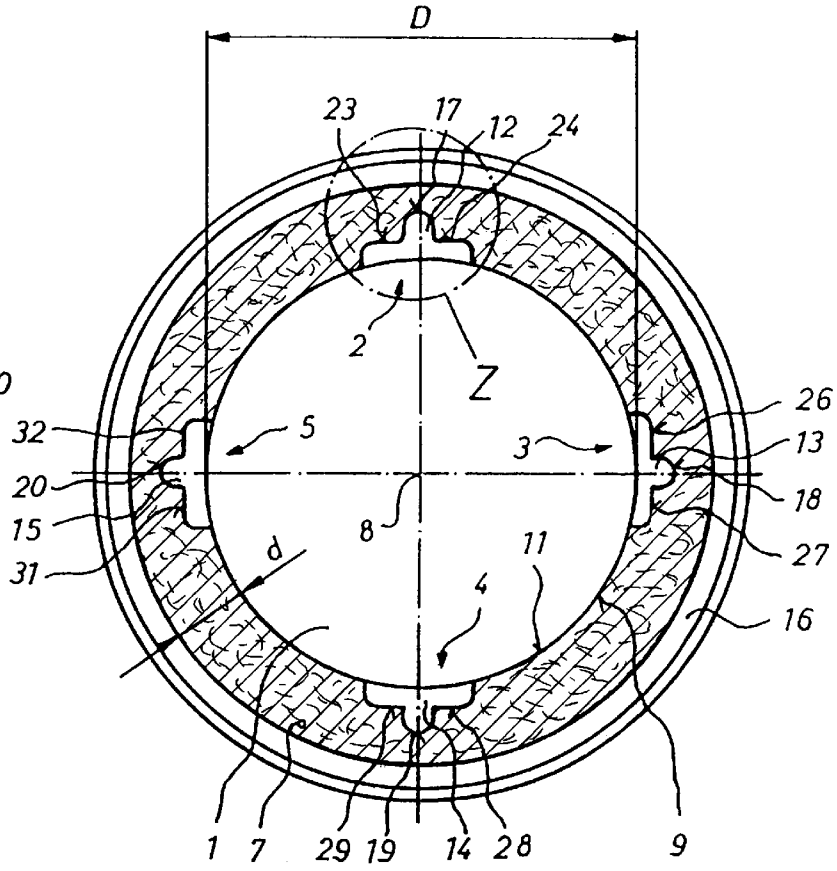
FIG. 2 is a cross-sectional view of the device of FIG. 1 and taken along line II—II of FIG. 1.
Figure 1:
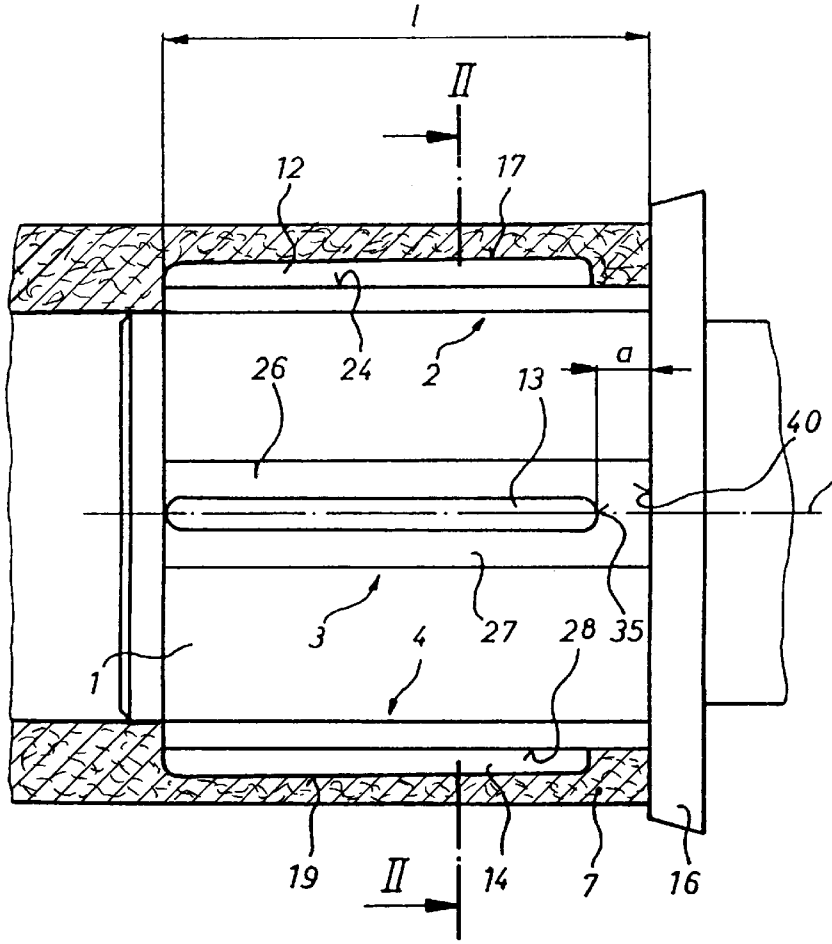
FIG. 1 is a side elevation view, partly in section of a preferred embodiment of a support journal in accordance with the present invention and showing the clamping strips in their working position.

Referring initially to FIG. 1, there may be seen generally at 1 a preferred embodiment of a supporting journal in accordance with the present invention. Support journal 1 is generally cylindrical in shape and has an enlarged collar 16 at one end. It will be understood that the support journal 1 is extendable and retractable along a linear axis 10 and is typically a part of a roll stand in a web fed rotary printing press which is not specifically shown in the drawings. The supporting journal 1 is extendable into an open end of a winding tube, generally at 7, which typically forms the supporting core for a paper web roll. The tube 7 can consist of spirally wound strips of kraft paper and has a wall thickness "d", as shown in FIG. 2, of up to approximately 25 mm. The winding tube 7 is wound with a paper web and acts as a support for the paper web.

Figure 4:
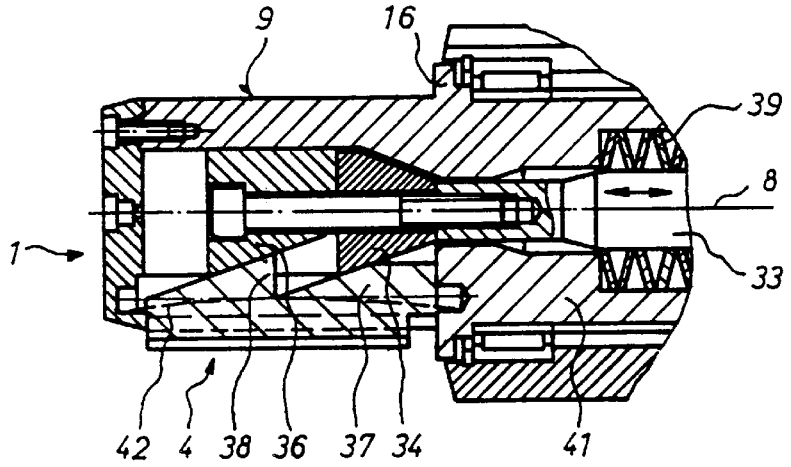
FIG. 4 is a side elevation view, partly in section of the supporting journal and showing the drive arrangement for the radially shiftable clamping strips.

Again referring to FIGS. 1 and 2, the supporting journal 1 has a plurality of, such as four, clamping strips 2, 3, 4 and 5 which are distributed at equal circumferential distances from each other about the periphery 9 of the journal 1. These clamping strips 2–5 each extend axially along the surface 9 and are generally parallel to a central axis of rotation 8 of the supporting journal 1. Each of these clamping strips 2–5 is supported for radial movement out from the peripheral surface 9 of journal 1 into engagement with an inner peripheral wall 11 of the winding tube 7. The specific drive arrangement for each of the clamping strips 2–5 is shown in FIG. 4 and will be discussed in detail shortly.

Figure 3:
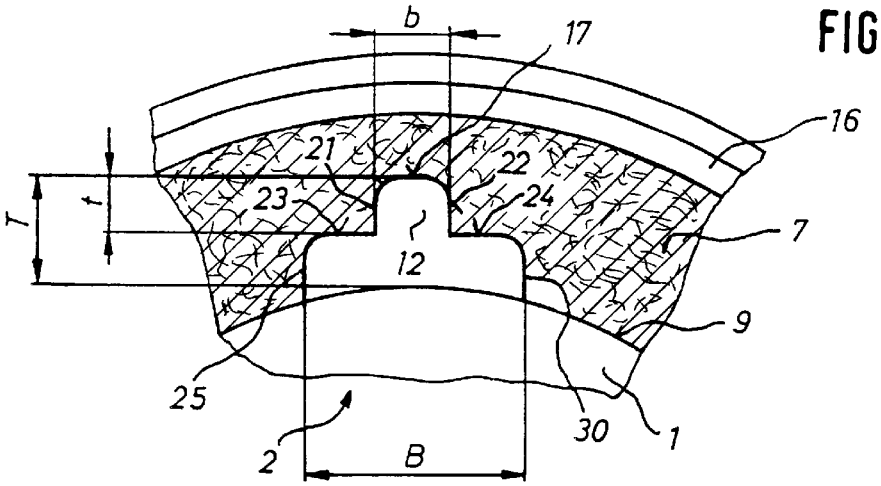
FIG. 3 is an enlarged detail view of the portion of FIG. 2 encircled at Z and showing a material compressing rib.

As may be seen in FIGS. 1 and 2, and most clearly in the enlarged view shown in FIG. 3, each of the clamping strips 2–5 has a radially outer clamping surface which is engageable with the inner surface 11 of the winding tube 7. This clamping surface is provided with a generally centrally situated material concentrating or compacting rib 12–15. The compacting rib 12–15 for each associated clamping strip 2–5 extends in the linear axial direction 10 of each strip and is thus parallel to the direction of the axis of rotation 8 of the support journal 1. As is depicted in the greatest detail in FIG. 3, each of the material compacting or concentrating ribs 12–15 has a rounded top surface 17–20, respectively which faces the inner surface 11 of the tube 7. Each rib 12–15 extends radially outwardly beyond the remainder of the clamping surface by a distance "t" past two shoulder surfaces 23 and 24; 26 and 27; 28 and 29; or 31 and 32 for each associated clamping strip 2–5. These first and second shoulder surfaces, such as shoulder surfaces 23 and 24 also face the interior peripheral surface 11 of winding tube 1 and extend in the direction of the linear axis 10. It will be understood that while FIG. 3 shows only the clamping strip 2 that the other three clamping strips 3–5 have the same clamping surface structure.

Each of the material compressing or compacting ribs 12–15 has, in addition to its rib top surface 17–20, a pair of lateral side faces 21 and 22, as may be seen most clearly in FIG. 3. Each of these side faces 21 and 22 has a height "t". The two shoulder surfaces 23 and 24 for clamping rib 12, as well as the corresponding shoulder surfaces for the several other clamping ribs, have outer rounder edges. These shoulder surfaces 23 and 24 have a penetration depth into the material of the tube 7 of T-t, as is shown in FIG. 3. The cross-sectional profile of each clamping strip 2 shown in FIG. 3, includes a first lower lateral face 25, the first shoulder 23, the first upper lateral face 21, the rounded top surface 17, the second upper lateral face 22, the second shoulder face 24, and a second lower lateral face 30. These surfaces form a profile line, consisting of surfaces 25, 23, 21, 17, 22, 24 and 30 of each clamping strip 2–5 with this profile line being longer than a width B of a projection face of the clamping strip. The two shoulder surfaces 23 and 24 for clamping strip 2, as well as the shoulder surfaces for the other similar clamping strips together have four times the surface of the rounded top surface 17 of the clamping rib 12 of the clamping strip 2. Each of the supporting journals 1 can have a diameter D which is preferably three, four or five times the width B of each of the clamping strips 2 to 5. The width B of the clamping strip's overall clamping surface is preferably four times the width "b" of the rounded top 17 of the clamping rib 12.

Figure 5:
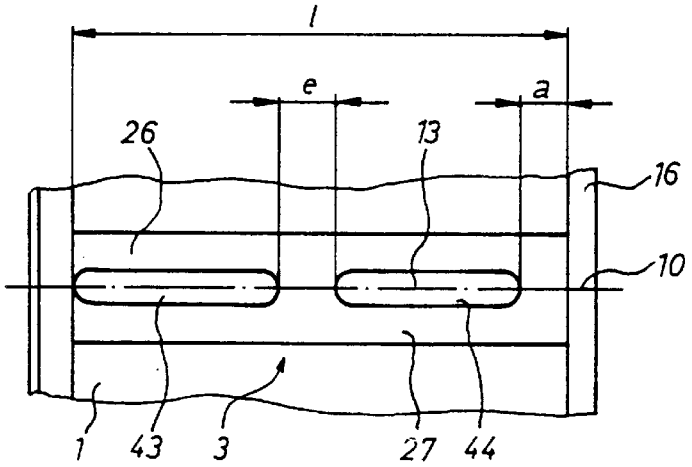
FIG. 5 is a top plan view of a portion of a supporting journal and showing a first alternate arrangement of clamping ribs on a clamping strip.
Figure 6:
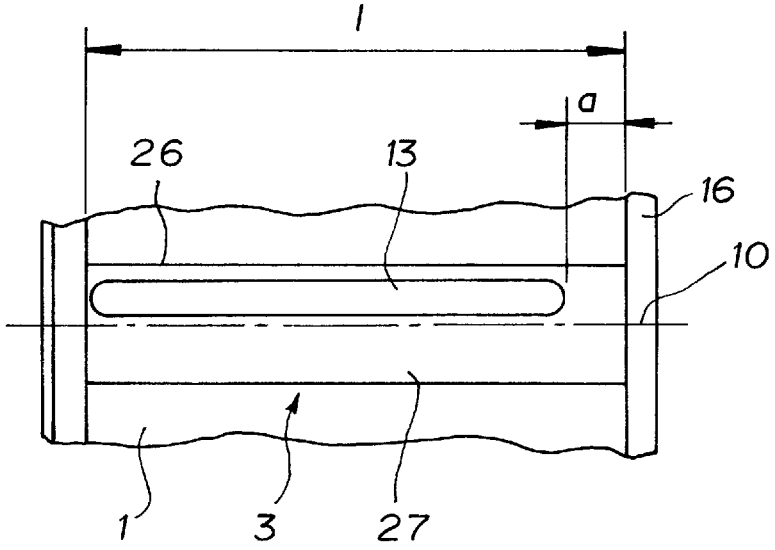
FIG. 6 is a top plan view of a portion of a supporting journal and showing a second alternate arrangement of clamping ribs on a clamping strip.

Turning now again to FIG. 1, the length "l" of each clamping strip 2–5 is generally the same as the length of the supporting journal 1. However, the length of the material compacting or concentrating rib 12 associated with the clamping strip 2 is less than the length "l". A gap "a" of, for example 5 mm is provided between the collar 16 at the supported end of the support journal 1 and an end face 35 of the rib 12 which is facing the collar 16. An end 40 of the clamping strip 2 extends to the collar 16. The length "l" of the clamping strip 2 is greater than the length "l"-"a" which is the length of the material compressing or compacting rib 12. It would also be possible, as depicted in FIG. 5, to provide each clamping strip 2–5 with a pair of material compacting ribs 43 and 44 instead of the single rib 12. These two ribs 43 and 44 could be spaced from each other by an intermediate rib spacing distance "e" of, for example 5 mm. The overall length "l" of the clamping strip 2 would thus be greater than the combined lengths of the two ribs 43 and 44 by an amount of "l"-"a"-"e". In a further variant which is depicted in FIG. 6 of the drawings, the material compressing or compacting rib 12–15 for each clamping strip 2–5, could be relocated so that the rib is off-center on one of the shoulder surfaces 23, 24, 26, 27, 28, 29, 31 or 32. This would locate the rib outside of the linear axis 10 of each of the clamping strips 2–5.

All of the clamping strips 2–5 are shiftable radially inwardly and outwardly with respect to the peripheral surface 9 of the supporting journal 1. This is accomplished by a clamping strip drive assembly which is shown in detail in FIG. 4. As may be seen, several frustoconical wedges 34 and 36 are disposed in axially spaced relationships on a piston rod 33 of a piston-cylinder unit which can be charged with compressed air. Each of these wedges 34 and 36 is in engagement with cooperatively shaped counter-wedges 37 and 38 that are formed on a radially inner surface of each of the clamping strips 2–5. It will be understood that only the structure of clamping strip 4 is shown in FIG. 4 for clarity of illustration. The radial inner surface of each clamping strip 2–5 is that side which faces the axis of rotation 8 of the supporting journal 1. The piston and piston rod 33 is biased to the right, as depicted in FIG. 4, into its working position in which the clamping strips 2–5 are extending radially outwardly, by a plurality of Belleville washers in the form of a disk spring package 39 which encloses or surrounds the piston rod 33. A housing wall 41 constrains the disk spring package 39 which is in engagement with the piston bottom. If a charge of compressed air is supplied to the piston cylinder unit from a suitable source, the piston and piston rod 33 will move to the left, as seen in FIG. 4, to a clamping strip release or disengagement position. Once this has been done, the several clamping strips 2–5 are free to move radially inwardly with respect to the supporting journals. Now these journals can be retracted out of the ends of a paper tube 7, and the tube can be removed from the roll stand or other similar support. The charge of compressed air is sufficient to overcome the force of the disk spring package 39. The rib top surfaces 17–20 of the various material compressing ribs 12–15 will now be able to move into the supporting journals 1 until they are beneath the peripheral surface 9 of the journal 1. A leaf spring 42 is provided to restore the clamping strips 2 to 5 to their retracted positions.

After the supporting journals 1 have been retracted out of the ends of a first paper tube 7, and that first tube has been removed, a second tube 7 can be substituted for the first, and the support journals 1 can be extended into the ends of the newly situated paper tube 7. The clamping strips 2–5 can then again be caused to move radially outwardly. This is accomplished by release of the compressed air from the cylinder of the piston-cylinder assembly. The disk spring package 39 will force the piston rod 33 to the right, as shown in FIG. 4 and will cause the clamping strips 2–5 to move radially outwardly with respect to the supporting journal 1. Initially, the material concentrating or compacting ribs 12–15 will contact the interior peripheral surface 11 of the tube 7 with their top surfaces 17. This initial penetration is to the depth "t". Subsequently, as illustrated in FIG. 3, the shoulder surfaces 23 and 24; 26 and 27; 28 and 29; and 31 and 32 of the four clamping strips 2–5 will also enter the tube 7 to a total penetration depth of T. At the minimum, this penetration depth T is 15% of the interior diameter D of the tube 7 or of the diameter of the support journal 1.

The clamping strips 2–5 of the support journal 1 in accordance with the present invention accomplish an interlocking connection between the support journal 1 and the paper tube 7. This interlocking connection is effective in transferring large forces between the tube 7 and the support journal 1 in a manner which will not tear or burst the tube 7. The tube will further not be cut or torn by the clamping strips 2–5. This will allow the tube 7 to be used again without problems. Although it has not been discussed in detail, it will be understood that the supporting journals 1, together with the drive for the clamping strips 2–5, as they are shown in FIG. 4, can be displaced in the axial direction 10 by the use of generally conventional drive elements.

While a preferred embodiment of a supporting journal for winding tubes in accordance with the present invention has been set forth fully and completely hereinabove, it will be apparent to one of skill in the art that a number of changes in, for example the overall size of the tube, the drive assembly for rotating the support journals, the type of printing press used and the like can be made without departing from the true spirit and scope of the present invention which is accordingly to be limited only by the following claims.

What is claimed is:

1. A support for a winding tube comprising:

a generally cylindrical support journal having a peripheral surface, and being rotatable about an axis of rotation, said support journal being extendable and retractable about a linear axis into and out of an end of a winding tube to be supported, said support journal having a winding tube insertion end and a supported end and further having a first axial length between said winding tube insertion end and said supported end;

a collar at said supported end of said support journal said collar being engageable with an end face of a winding tube when said support journal is extended into the winding tube;

a plurality of spaced, generally parallel clamping strips distributed at equal circumferential distances from each other about said peripheral surface of said support journal and each extending along said peripheral surface in the direction of said linear axis, each said clamping strip having a length generally the same as said first axial length and having a radially outer clamping surface having said first axial length, and a radially inner counter-wedge surface, each said clamping strip being movable radially with respect to said peripheral surface of said support journal between a radially retracted position and a radially extended position in which said entire radially outer clamping surface is engageable with the winding tube;

means to move each of said clamping strips radially outwardly from said peripheral surface to said radially extended position said means including an axially shiftable piston rod in said support journal, said piston rod being shiftable axially to move said spaced clamping strips, said piston rod having wedge surfaces, said wedge surfaces engaging said counter-wedge surfaces on each said clamping strip;

a disk spring package on said piston rod, said disk spring package including a plurality of spring washers surrounding said piston rod, said disk spring package shifting said piston rod axially to move each said clamping strip radially outwardly to said extended position;

at least a first winding tube compaction rib on said clamping surface of each said clamping strip, each said rib having a second axial length less than said first axial length, and a rib top surface projecting radially outwardly on said clamping strip beyond said clamping surface and separating said clamping surface into spaced first and second shoulder surfaces, each said rib extending along said clamping surface of said clamping strip in the direction of said linear axis of said support journal; and an end face on each said rib facing said collar, each said rib end face being spaced from said collar to define a gap between said end face of said rib and said collar.

2. The support of claim 1 wherein each said rib is disposed centered between said first and second shoulder faces.

3. The support of claim 1 wherein each said rib is disposed off-centered between said first and second shoulder faces.

4. The support of claim 1 further including a second rib on said clamping surface of each of said clamping strips, said first and second ribs on each of said clamping strips being spaced from each other along said axis of rotation.

* * * * *